US009115412B2

(12) United States Patent
Zhan

(10) Patent No.: US 9,115,412 B2
(45) Date of Patent: Aug. 25, 2015

(54) METHOD OF MANUFACTURING DIRECT REDUCTION IRON AND REDUCTION FIRING APPARATUS

(71) Applicants: PANGANG GROUP COMPANY LTD., Panzhihua, Sichuan Province (CN); PANGANG GROUP PANZHIHUA IRON & STEEL RESEARCH INSTITUTE CO., LTD., Panzhihua, Sichuan Province (CN)

(72) Inventor: Jinlong Zhan, Panzhihua (CN)

(73) Assignees: PANGANG GROUP COMPANY LTD., Sichuan Province (CN); PANGANG GROUP PANZHIHUA IRON & STEEL RESEARCH INSTITUTE CO., LTD., Sichuan Province (CN)

( * ) Notice: Subject to any disclaimer, the term of this patent is extended or adjusted under 35 U.S.C. 154(b) by 159 days.

(21) Appl. No.: 13/909,763

(22) Filed: Jun. 4, 2013

(65) Prior Publication Data

US 2014/0150606 A1 Jun. 5, 2014

Related U.S. Application Data

(62) Division of application No. 12/963,865, filed on Dec. 9, 2010, now Pat. No. 8,475,707.

(30) Foreign Application Priority Data

Sep. 6, 2010 (CN) ..... 2010 1 0272988

(51) Int. Cl.
*C21B 13/00* (2006.01)
*C21B 13/10* (2006.01)

(Continued)

(52) U.S. Cl.
CPC ..... *C21B 13/00* (2013.01); *C21B 13/10* (2013.01); *C21B 13/146* (2013.01); *F27B 9/20* (2013.01); *F27B 9/26* (2013.01); *F27B 9/38* (2013.01); *F27B 9/39* (2013.01); *F27D 3/06* (2013.01)

(58) Field of Classification Search
CPC ..... C21B 13/10; C21B 13/146; C21B 13/00; F27B 9/20; F27B 9/26; F27B 9/38; F27B 9/39; F27D 3/06
USPC ..... 75/484
See application file for complete search history.

(56) References Cited

U.S. PATENT DOCUMENTS 3,005,699 A 10/1957 Erck et al.
3,336,018 A * 8/1967 Cuvelier et al. ..... 432/78

FOREIGN PATENT DOCUMENTS

CA 2299109 C 8/2000
CN 1080961 A 1/1994

(Continued)

*Primary Examiner* — George Wyszomierski
*Assistant Examiner* — Tima M McGuthry Banks
(74) *Attorney, Agent, or Firm* — Brooks Kushman P.C.

(57) ABSTRACT

A method of manufacturing direct reduction iron and a reduction firing apparatus. The apparatus has a reduction furnace including a left chamber, a right chamber, a material containing device, a step mechanism, a slag distributing device, a charging device, heating burners, a fume extraction path, a charging device, a material receiving tank and a slag discharging path. The method includes the following steps: distributing and charging the slag in the material containing device; carrying and sending the material containing device through a preheating station, a heating station and a reduction station sequentially. Meanwhile, heating the material to be reduced by a combustion of fuel with the heating burners; discharging the reduced material into the material receiving tank; placing the material device from which the material is discharged into the feeding side of the other chamber, then a next work circulation begins.

14 Claims, 3 Drawing Sheets

(51) Int. Cl.

| | |
|---|---|
| ***F27B 9/20*** | (2006.01) |
| ***F27B 9/26*** | (2006.01) |
| ***F27B 9/38*** | (2006.01) |
| ***F27B 9/39*** | (2006.01) |
| ***C21B 13/14*** | (2006.01) |
| ***F27D 3/06*** | (2006.01) |

(56) References Cited

FOREIGN PATENT DOCUMENTS

| | | | | |
|---|---|---|---|---|
| CN | 1277265 | A | | 12/2000 |
| GB | 424273 | A | * | 2/1935 |
| WO | 9963119 | A1 | | 12/1999 |

* cited by examiner

METHOD OF MANUFACTURING DIRECT REDUCTION IRON AND REDUCTION FIRING APPARATUS

CROSS-REFERENCE TO RELATED APPLICATIONS

This application is a division of U.S. application Ser. No. 12/963,865 filed Dec. 9, 2010, now U.S. Pat. No. 8,475,707, which, in turn, claims priority to Chinese application No. 201010272988.9 filed Sep. 6, 2010, the disclosures of which are incorporated in their entirety by reference herein.

FIELD OF THE INVENTION

The present invention relates to a metallurgical technical field, and more particularly, to a method of manufacturing direct reduction iron and a reduction firing apparatus used in the method.

DESCRIPTION OF RELATED ART

With a gradual exhaustion of coking coal suitable for coking and an increasing requirement for environmental protection, it is an inevitable trend of development to substitute the traditional blast furnace ironmaking with direct reduction iron. Direct reduction iron production has been explored all the time, e.g. a shaft furnace method, a tunnel kiln method, a rotary kiln method, a rotary hearth furnace method, or even a method proposed by someone for manufacturing direct reduction iron by using a concurrent firing method on a sintering machine.

Firing with the shaft furnace has a problem that a production capacity may be affected by discharging difficulty due to accretion; firing with the tunnel kiln has problems such as long heating time and high energy consumption; firing with the rotary kiln also has a problem of long heating time, and easily causes a "ringing" malfunction; firing with the rotary hearth furnace has problems such as low thermal efficiency, high energy consumption and low production efficiency; firing on the sintering machine has problems that the reduction atmosphere is hardly controlled and thus the reduction temperature cannot be increased. Methods of manufacturing direct reduction iron in the prior art almost have problems such as considerable resource restriction, high energy consumption and low production efficiency, thus these methods have no competitive advantage with respect to the blast furnace ironmaking.

The Chinese patent with a publication No. CN1080961A discloses a process and an apparatus for reducing spongy iron in a coal-based shaft furnace. In the method, a grate plate is additionally added to an ordinary shaft furnace to increase the permeability, thereby realizing coal-based reduction. However, in comparison with the ordinary shaft furnace, the disadvantages of this method are more obvious. In particular, the shaft furnace mainly has a problem of nodulation due to the molten materials adhering to the furnace wall, resulting in discharging difficulty, thus smooth production cannot be ensured. In the method disclosed in CN1080961A, materials necessarily slide down on the grate plate having an inclination, however, the sliding is not smooth even though the materials do not resolve; furthermore, the materials contacted with the grate plate has the highest temperature and easily melt, thereby adhering to the grate plate instead of sliding down. And the generated nodulation cannot be treated during production, thus smooth production cannot be realized.

SUMMARY OF THE INVENTION

One of the objectives of the present invention is to overcome the above disadvantages, and provide a method of manufacturing direct reduction iron with a small limitation of resources shortage, which may improve the thermal efficiency of the reduction firing, decrease the energy consumption, and improve production efficiency and capacity of the reduction firing.

The technical solution adopted in the present invention to solve the above technical problems is that, a method of manufacturing direct reduction iron according to the present invention including the following steps: (1) carrying and sending a material containing device into the feeding side of one chamber of a dual-chamber stepping furnace by a discharging device; (2) transferring the material containing device to a slag distributing station by a step mechanism of the dual-chamber stepping furnace so as to uniformly distribute a layer of slag on grate bars of the material containing device by a slag distributing device; (3) moving the material containing device forward to a charging station so as to fill the material containing device with pellet material to be heated and reduced; (4) moving the material containing device forward to a preheating station, a heating station and a reduction station step by step, heating the pellet material by flames of heating burners, fumes of the flames penetrating material layers and the grate bars of the material containing device and being pumped out through a fume extraction path at a bottom of the chamber; (5) moving the material containing device forward step by step so as to reach a discharging port of the stepping furnace, opening a furnace gate to carry and send the material containing device outside of the furnace by the discharging device, closing the furnace gate, and turning over the material containing device to pour the pellet material reduced into a material receiving tank having a sealing cap; and (6) turning the material containing device back by the discharging device and the discharging device moving laterally so as to transfer the material containing device into the feeding side of the other parallel chamber of the dual-chamber stepping furnace, and starting the next circulation.

Another objective of the present invention is to provide a reduction firing apparatus using in the above method of manufacturing direct reduction iron.

One technical solution adopted in the present invention to solve the above technical problems is that: a reduction firing apparatus having a dual-chamber stepping reduction furnace, including: a left chamber having a feeding side and a discharging side, each having a furnace gate; a right chamber having a feeding side and a discharging side, each having a furnace gate; a material containing device for containing material and gaps are formed in the bottom thereof; a step mechanism for carrying and sending the material containing device so as to make the material containing device move forward step by step in the chamber; a slag distributing device disposed at the feeding sides of the left and right chambers; a charging device disposed at the feeding sides of the left and right chambers and positioned behind the slag distribution in a lengthwise direction of the chamber; heating burners disposed on the left and right chambers; a fume extraction path disposed at the bottoms of the left and right chambers and communicating with the left and right chambers through the gaps formed at the bottoms of the material containing device; a discharging device disposed outside of the furnace gates of the discharging sides of the left and right chambers; a material receiving tank with a sealing cap, which is disposed outside of the furnace gates of the discharging sides of the left and right chambers; and a slag discharging path disposed at a lower portion of the feeding sides of the left and right chambers corresponding to the slag distributing device and the charging device thereabove.

Another technical solution adopted in the present invention to solve the above technical problems is that, a reduction firing apparatus having a single-chamber stepping reduction furnace, including: a chamber having a feeding side and a discharging side, each having a furnace gate; a material containing device for containing material and gaps are formed in the bottom thereof; a step mechanism for carrying and sending the material containing device so as to make the material containing device movie forward step by step in the chamber; a slag distributing device disposed at the feeding side of the chamber; a charging device disposed at the feeding side of the chamber and positioned behind the slag distribution in a lengthwise direction of the chamber; heating burners disposed on the chamber; a fume extraction path disposed at the bottom of the chamber and communicating with the chamber through the gaps formed at the bottom of the material containing device; a discharging device disposed outside of the furnace gate of the chamber; a material receiving tank with a sealing cap, which is disposed outside of the furnace gate of the feeding side and discharging side of the chamber; and a slag discharging path disposed at a lower portion of the feeding side of the chamber corresponding to the slag distributing device and the charging device thereabove.

A third technical solution adopted in the present invention to solve the above technical problems is that, a reduction firing apparatus having a single hearth down-draft reduction furnace, including: a chamber having a feeding side and a discharging side, each having a furnace gate; a material containing device for containing material and gaps are formed in the bottom thereof; a step mechanism for carrying and sending the material containing device so as to make the material containing device move forward step by step in the chamber; a slag distributing device disposed at the feeding side of the chamber; a charging device disposed at the feeding side of the chamber and positioned behind the slag distribution in a lengthwise direction of the chamber; heating burners disposed on the chamber; a fume extraction path disposed at the bottom of the chamber and communicated with the chamber through the gaps formed at the bottom of the material containing device; a discharging device disposed outside of the furnace gate of the chamber; a material receiving tank with a sealing cap, which is disposed outside of the furnace gate of the feeding side and discharging side of the chamber; and a slag discharging path disposed at a lower portion of the feeding side of the chamber corresponding to the slag distributing device and the charging device thereabove.

Beneficial effects produced by the present invention are listed as follows:

(1) It is realized to make high temperature fumes penetrate material layers, heat is transferred to pellet material to be reduced through the two ways of radiation and conduction, thus the thermal efficiency is increased, and gas generated during the reduction process of pellet is substituted rapidly when the fumes penetrates material layers.

(2) After penetrating material layers, main heat is transferred to pellet material to be reduced, and afterwards the high temperature fumes reach the grate bars of the material containing device, and the material containing device is transferred into the furnace after pouring out the reduced pellet material, thus the material containing device works in a state with constant temperature and can make a longer service life.

(3) Since the material containing device can be easily changed and repaired without stopping production or changing production pace, the production efficiency of the dual-chamber stepping reduction furnace is increased.

(4) Since the slag is distributed on the material containing device, which can prevent the reduced material adhering to the grates bars of the material containing device, the charging and discharging of material are just simple pouring operations, thus the smooth reduction firing production can be ensured.

(5) The present invention can control the reduction temperature and the reduction atmosphere accurately, and can obtain a high metallization rate, a wide range of production applicability and a low production cost.

MAIN REFERENCE NUMERALS

Figure 1:
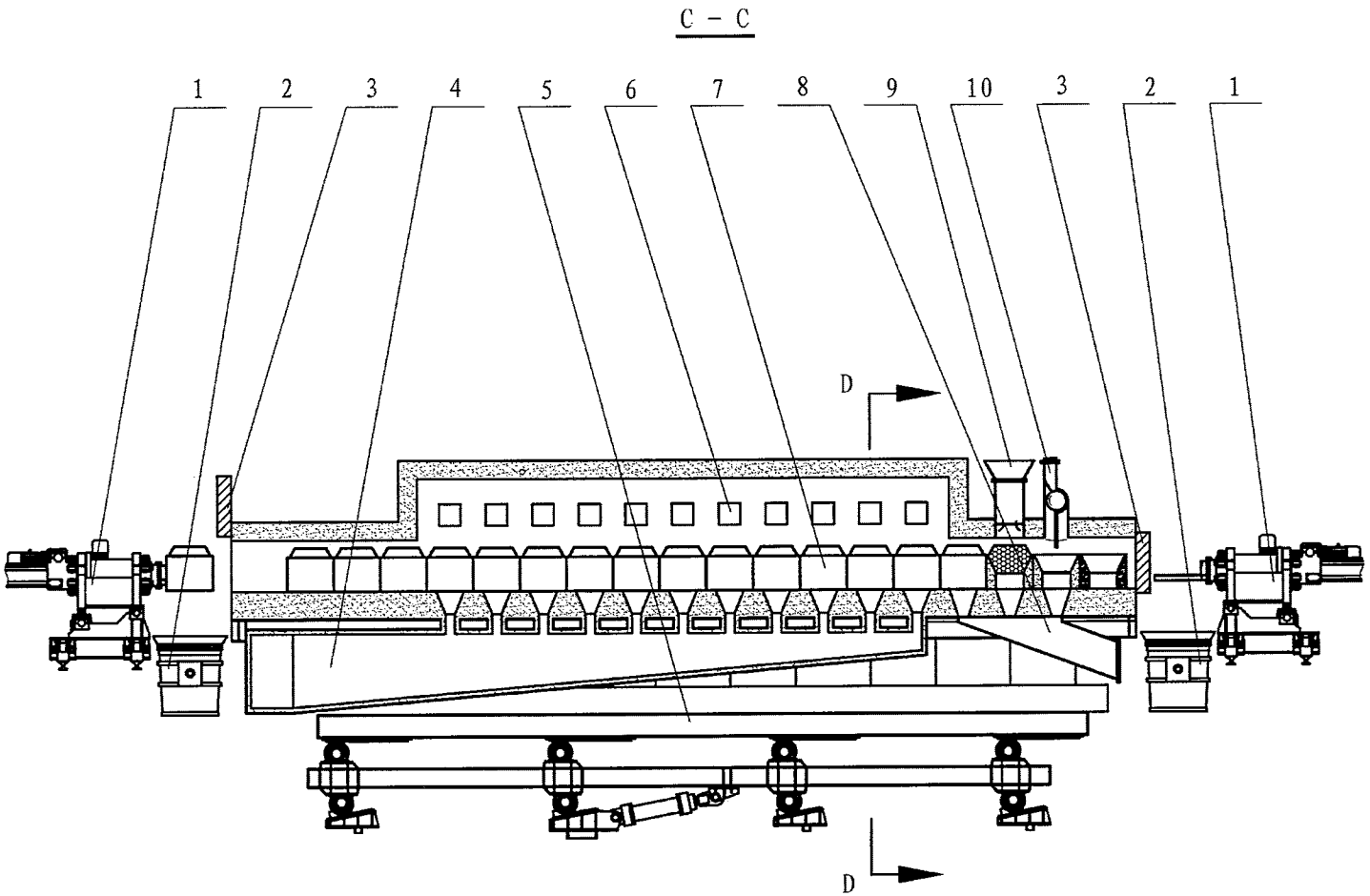
FIG. 1 is a schematic view of a lengthwise cross-section C-C of a dual-chamber step reduction furnace or a single-chamber step reduction furnace according to a reduction firing apparatus of the present invention.

1: discharging device;
2: material receiving tank;
3: furnace gate;
4: fume extraction path;
5: step mechanism;
6: heating burner;
7: material containing device;
8: slag discharging path;
9: charging device;
10: slag distributing device;
11: left chamber;
12: right chamber;
13: hearth.

DETAILED DESCRIPTION OF THE PREFERRED EMBODIMENTS

Hereinafter, the present invention will be described in detail in connection with the accompanying drawings and embodiments.

The method of manufacturing direct reduction iron according to the present invention includes the following steps:

(1) carrying and sending a material containing device into the feeding side of one chamber of a dual-chamber stepping furnace by a discharging device;

(2) transferring the material containing device to a slag distributing station by a step mechanism of the dual-chamber stepping furnace so as to uniformly distribute a layer of slag on grate bars of the material containing device by a slag distributing device;

(3) moving the material containing device forward to a charging station so as to fill the material containing device with pellet material to be heated and reduced by a charging device;

(4) moving the material containing device forward to a preheating station, a heating station and a reduction station step by step, heating the pellet material by flames of heating burners, fumes of the flames penetrating material layers and the grate bars of the material containing device and being pumped out through a fume extraction path at a bottom of the chamber;

(5) moving the material containing device forward step by step so as to reach a discharging port of the stepping furnace, opening a furnace gate to carry and send the material containing device to outside of the furnace by the discharging device, closing the furnace gate, and turning over the material containing device to pour the reduced pellet material into a material receiving tank having a sealing cap; and (6) turning the material containing device back by the discharging device and the discharging device moving laterally so as to transfer the material containing device into the feeding side of the other parallel chamber of the dual-chamber stepping furnace, and entering the next circulation.

In the above technical solution, the material containing device in the step (1) is a material containing device that has just been baked or from which the high temperature material has just been poured away, so the material containing device works at a substantially constant temperature, thus has a relatively long service life.

The slag in the step (2) has a particle size larger than a distance between adjacent grate bars of the material containing device, which can effectively prevent the reduced material from affecting the permeability property of the material containing device due to the adherence to the grate bars of the material containing device after melting. If a reduction temperature required is lower than a molten temperature of the material, the above problem will not exist, thus the step (2) can be omitted and the slag distributing device of the reduction furnace can be omitted.

The pellet material to be heated and reduced in the step (3) can also be granular material or lump material.

Filling the material containing device with pellet material to be heated and reduced in the step (3) may be performed by directly pouring the pellet material to be reduced into the material containing device, thus the process is simple and reliable.

The slag distributed in the material containing device in the step (2) and the pellet material to be reduced in the step (3) may be heated by the fumes from the reduction furnace outside of the reduction furnace, thus in addition to the decrease of energy consumption for reduction, the service life of the material containing device can be prolonged.

The fumes of the flames passes through the material layers and is pumped out by the fume extraction path at the bottom of the chamber during the heating of the pellet material by the flames of the heating burners in the step (4), so the heat of the flames is transferred to the reduced pellet material in two ways of radiation and conduction, thus not only the thermal efficiency is improved, but the gas generated during the reduction process of pellet material is substituted rapidly, thereby improving the reduction efficiency. Therefore, the reduction is a high-efficiency and energy-saving production.

The flames of the heating burners in the step (4) may be flames generated by burning gas fuel, liquid fuel or solid fuel. For example, the gas fuel may be natural gas and various coal gases; the liquid fuel may be heavy oil; the solid fuel may be carbon powders, coal powders, etc. Furthermore, in the present invention, the flames formed from the heating burners may be generated by burning the combination of various fuels.

The step (4) may further include respectively controlling the combustions of fuel to be over oxidation combustion, full oxidation combustion and insufficient oxidation combustion at the preheating station, the heating station and the reduction station, so the thermal efficiency of the fuel can be improved and the reduction atmosphere can be controlled accurately. More particularly, the combustion at the heating burners corresponding to the preheating position is controlled to be over oxidation combustion or full oxidation combustion, thus the thermal efficiency of the fuel can be improved; the combustion at the heating burners corresponding to the heating station is controlled to be over oxidation combustion or full oxidation combustion thus the thermal efficiency of fuel can be further improved; and the combustion at the heating burners corresponding to the reduction station is controlled to be insufficient oxidation combustion, thereby the reduction atmosphere can be controlled accurately so as to facilitate improving the reduction efficiency. In addition, at the reduction station, the flames of the heating burners may be quenched and metallic oxides in the materials are reduced only through a reductant in the materials.

In the step (4), a required reduction temperature and atmosphere can be obtained by reducing different components of the pellet material through controlling burning flames, and a required reduction time can be obtained by setting the number of steps and setting different stepping paces, thus the method according to the present invention can manufacture non-ferrous material by a firing reduction method, in addition to the production of direct reduction iron. For example, mineral material which is difficult to be separated, such as manganese (Mn), nickel (Ni), copper (Cu), tin (Sn), antimony (Sb) and the like, may be treated by means of reduction firing according to the present invention. Additionally, the present invention may also be used for removing impurities from a concentrated ore and concentrating a crude ore. Preferably, a vanadium titano-magnetite may be treated by using the method of the present invention.

Pouring the reduced pellet material into the material receiving tank having a sealing cap in step (5) is an intermittent instant operation; the sealing cap of the material receiving tank can close in time. Thus, the reduced pellet material can be prevented from being oxidized; in addition, the temperature of the receiving material tank having the sealing cap may be maintained so as to further reduce the pellet material, thereby improving a metal yielding rate.

The process of transferring the containing material device into the feeding side of the other parallel chamber of the dual-chamber stepping furnace in the step (6), may further include: if the material containing device is found to be damaged or adhered with a great deal of molten materials at an inner wall, the material containing device is lifted away and repaired while mounting a new baked material containing device for the other parallel chamber of the dual-chamber stepping furnace. An operation of repairing the material containing device or baking the material containing device is an offline operation which is not associated with the reduction production, thus work paces of the reduction production may not be affected and the reduction production can be ensured for smooth manufacture.

After turning back the material containing device by the discharging device in the step (6), the material containing device may be transferred back to the feeding side of the current chamber by a crane or a trolley, etc., so the production circulation may be achieved in one chamber, thus the reduction furnace may be changed into a single-chamber stepping reduction furnace.

The material containing device in the step (1) may be directly charged with the material to be reduced, be transferred to a position under the heating burners of the reduction furnace by the discharging device, and stopped under the heating burners. The flames from the heating burners is fired, adjusted and quenched at different periods, and thus the required reduction temperature and atmosphere are obtained. After completing reduction process, the material containing device are delivered out of the reduction furnace by the discharging device, then the reduced material are poured into the material receiving tank, thus the reduction furnace may be changed into a single hearth down-draft reduction furnace.

Hereinafter, embodiments of the reduction firing apparatus according to the present invention will be described by reference to the accompanying drawings.

Figure 2:
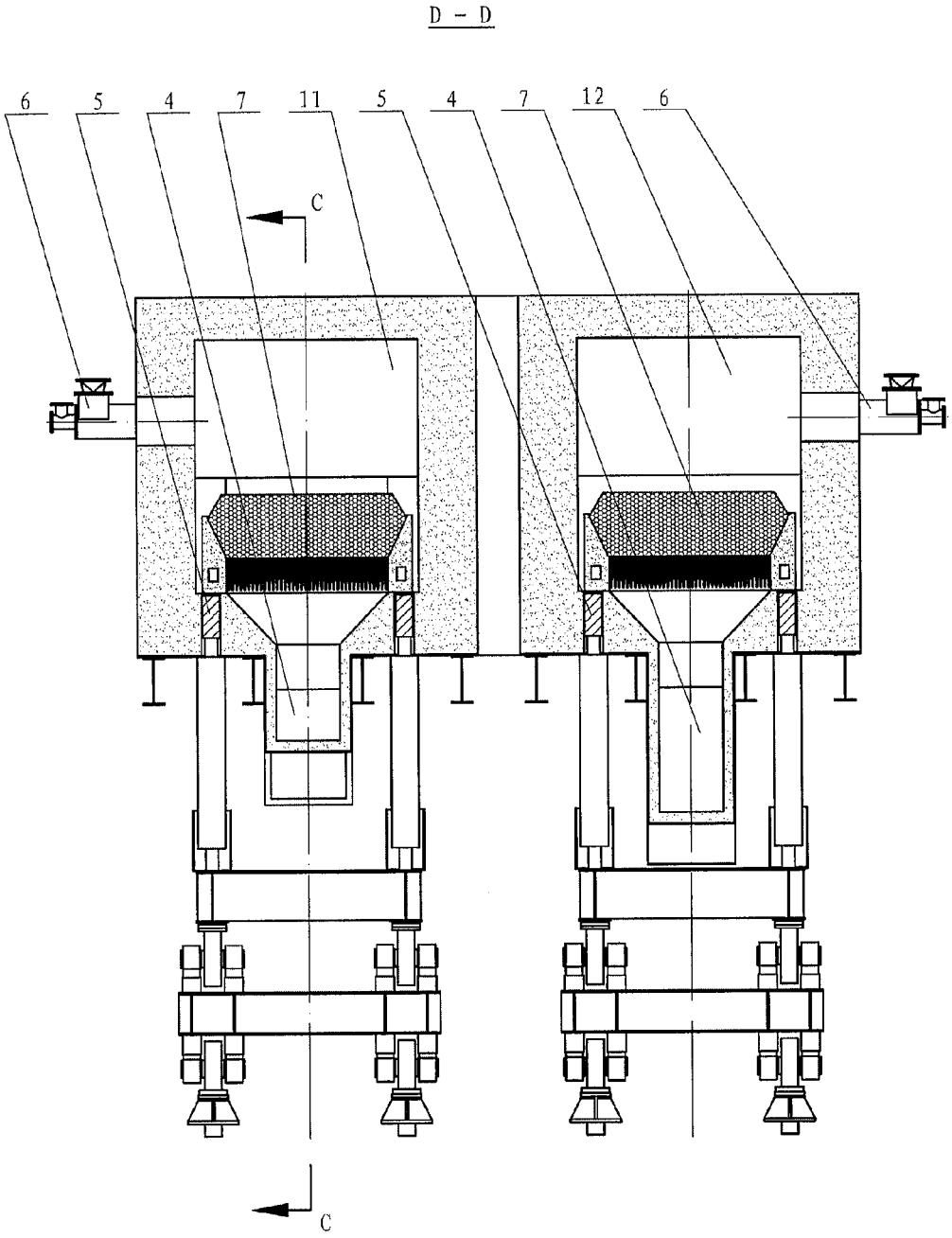
FIG. 2 is a schematic view of a widthwise cross-section D-D of a dual-chamber step reduction furnace according to a reduction firing apparatus of the present invention.

As shown in FIGS. 1 and 2, the reduction firing apparatus of the present invention may be a dual-chamber stepping reduction furnace, which includes: a left chamber 11 having a feeding side and a discharging side, each having a furnace gate 3; a right chamber 12 having a feeding side and a discharging side, each having a furnace gate 3; a material containing device 7 for containing material and gaps are formed at the bottom thereof; a step mechanism 5 for carrying and sending the material containing device 7 so as to make the material containing device 7 move forward step by step in the chamber; a slag distributing device 10 disposed at the feeding sides of the left and right chambers 11 and 12; a charging device 9 disposed at the feeding sides of the left and right chambers 11 and 12 and positioned behind the slag distribution 10 in a lengthwise direction of the chamber; heating burners 6 disposed on the left and right chambers 11 and 12; a fume extraction path 4 disposed at the bottoms of the left and right chambers 11 and 12 and communicating with the left and right chambers 11 and 12 through gaps formed at the bottoms of the material containing device 7; a discharging device 1 disposed outside of the furnace gates 3 of the discharging sides of the left and right chambers 11 and 12; a material receiving tank 2 with a sealing cap, which is disposed outside of the furnace gates 3 of the discharging sides of the left and right chambers 11 and 12; and a slag discharging path 8 disposed at a lower portion of the feeding sides of the left and right chambers 11 and 12 and corresponds to the slag distributing device 10 and the charging device 9 thereabove.

The left chamber 11 and the right chamber 12 are arranged in parallel, and the feeding side of the left chamber 11 is aligned with the discharging side of the right chamber 12, similarly, the feeding side of the right chamber 12 is aligned with the discharging side of the left chamber 11.

The material containing device 7 are mounted with grate bars having an up-and-down through gap at the bottom thereof, thus can bear the impact of material, high temperature baking and scouring by a high temperature air flow.

In the present invention, the material containing device 7 may include a left side wall constructed by a left fixing retaining wall, a right side wall constructed by a right fixing retaining wall, a front side wall constructed by a front supporting beam and a front movable retaining wall connected to the front supporting beam through a bolt; a back side wall constructed by a back supporting beam and a back movable retaining wall connected to the back supporting beam through a bolt, and a bottom portion constructed by a plurality of grate bars formed with up-and-down through gaps that have front ends disposed between the front supporting beam and the front movable retaining wall and back ends disposed between the back supporting beam and the back movable retaining wall, wherein a framed supporting base is formed integrally by the left and right side walls and the front and back supporting beams. The retaining walls, the supporting beams and the grate bars may be formed of a material resistant to high temperature and impact, for example, a steel frame and a refractory material forming outside of the steel frame.

The stepping distance of the step mechanism 5 is equal to the length of the material containing device 7.

As shown in FIG. 1, the reduction firing apparatus may also be a single-chamber stepping reduction furnace which includes: a chamber having a feeding side and a discharging side, each having a furnace gate 3; a material containing device 7 for containing material and gaps are formed in the bottom thereof; a step mechanism 5 for carrying and sending the material containing device 7 so as to make the material containing device 7 move forward step by step in the chamber; a slag distributing device 10 disposed at the feeding side of the chamber; a charging device 9 disposed at the feeding side of the chamber and positioned behind the slag distribution 10 in a lengthwise direction of the chamber; heating burners 6 disposed on the chamber; a fume extraction path 4 disposed at the bottom of the chamber and communicated with the chamber through gaps formed at the bottom of the material containing device 7; a discharging device 1 disposed outside of the furnace gate 3 of the chamber; a material receiving tank 2 with a sealing cap, which is disposed outside of the furnace gate 3 of the feeding side and discharging side of the chamber; and a slag discharging path 8 disposed at a lower portion of the feeding side of the chamber and corresponding to the slag distributing device 10 and the charging device 9 thereabove.

The material containing device 7 are mounted with grate bars having an up-and-down through gap at the bottom thereof, thus can bear the impact of material, high temperature baking and scouring by a high temperature air flow.

The stepping distance of the step mechanism 5 is equal to the length of the material containing device 7.

Figure 3:
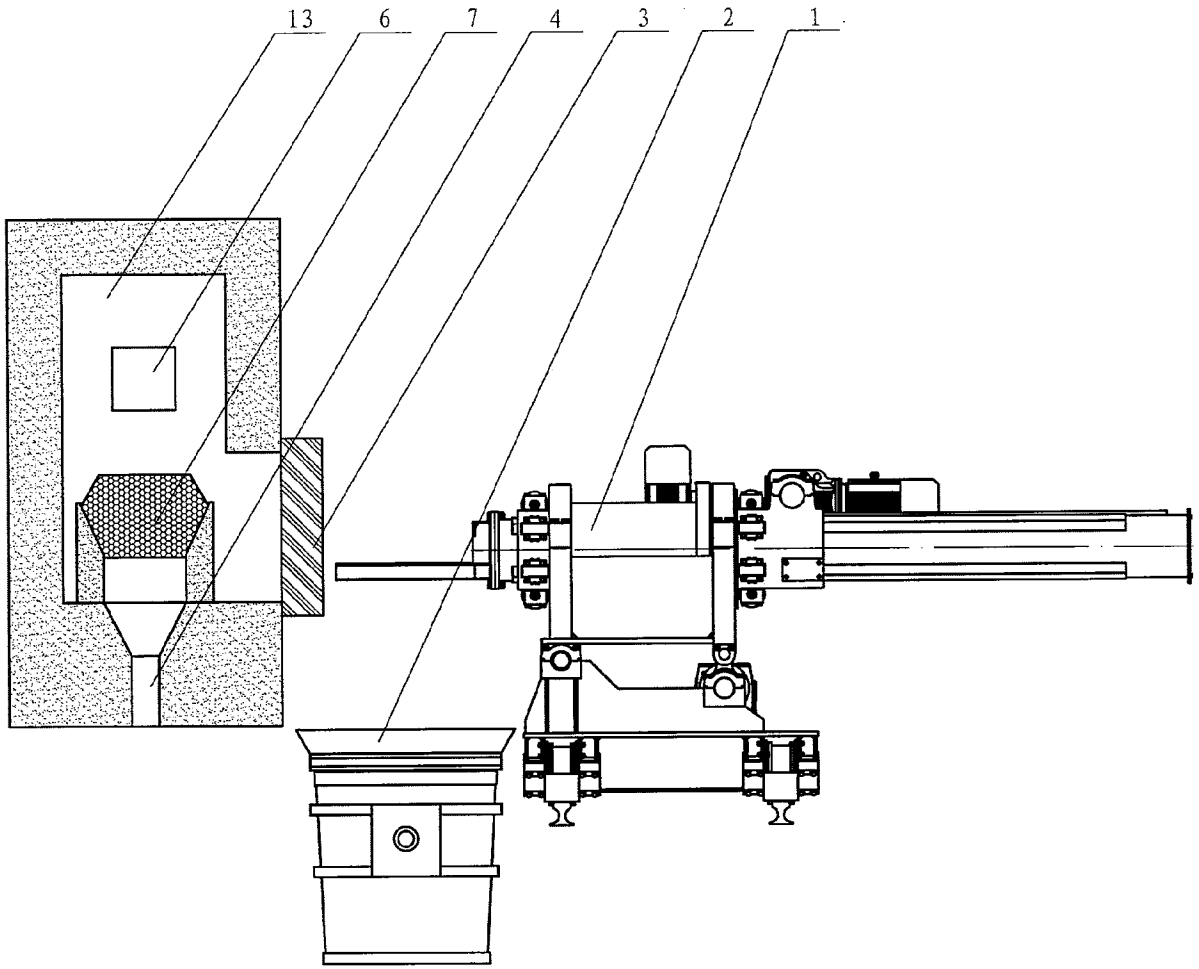
FIG. 3 is a schematic cross-sectional view of a single hearth down-draft reduction furnace according to a reduction firing apparatus of the present invention.

As shown in FIG. 3, the reduction firing apparatus of the present invention may also be a single hearth down-draft reduction furnace which includes: a hearth 13 having one furnace gate 3; a heating burner 6 disposed on the hearth 13; a material containing device 7 for containing material and gaps are formed in the bottom thereof; a fume extraction path 4 disposed at the bottom of the hearth 13 and communicated with the hearth 13 through gaps formed at the bottom of the material containing device; a discharging device 1 and a material receiving tank 2 with a sealing cap, which are disposed outside the furnace gate 3 of the hearth 13; and a slag distributing device and a charging device (not shown in FIG. 3) arranged in parallel with the hearth 13.

The material containing device 7 are mounted with grate bars having an up-and-down through gap at the bottom thereof, thus can bear the impact of material, high temperature baking and scouring by a high temperature air flow.

In the single hearth down-draft reduction furnace, the number of the heating burner 6 is one, and the flame of the heating burner 6 is fired, adjusted and quenched at different periods, an the required reduction temperature and atmosphere can be obtained.

Hereinafter, the specific application of the dual-chamber stepping reduction furnace of the reduction firing apparatus according to the present invention will be described.

As shown in FIGS. 1 and 2, the material containing device 7 which is empty is transferred into the feeding side of the left chamber 11 (or the right chamber 12) of the dual-chamber stepping reduction furnace by the discharging device 1. The material containing device 7 is carried and sent forward by the step mechanism 5. The material containing device 7 moves forward to the slag distributing station so as to be uniformly distributed with a layer of slag on the grate bars thereof by the slag distributing device 10. The material containing device 7 moves forward to the charging station so as to be filled with the pallet material to be reduced by the charging device 9. During distributing the slag and charging the material, the furnace materials leaked through the grate bars of the material containing device 7 are stacked in the slag discharging path 8, after a period of time, the valve at the end of the slag discharging path 8 is opened to discharge the leaked material in the slag discharging path 8. The material containing device 7 moves forward to the preheating station, the heating station and the reduction station step by step, and the pellet material in the material containing device 7 is heated by flames of heating burners, and fumes of the flames penetrates the pellet material layers and the grate bars of the material containing device 7 and is pumped out through the fume extraction path 4 at the bottom of the chamber of the stepping furnace. When the material containing device 7 moves forward to the furnace gate 3 of the discharging side of the dual-chamber stepping reduction furnace, the transformation of the reduction of the pellet material in the material containing device 7 is accomplished. Next, the furnace gate 3 is opened so that the material containing device 7 and the pellet material therein are carried outside of the furnace by the discharging device 1, and then the furnace gate 3 is closed. The sealing cap of the material receiving tank 2 is opened so that the pellet material reduced in the material containing device 7 is poured into the material receiving tank 2 having the sealing cap by the discharging device 1, and then the sealing cap of the material receiving tank 2 is closed. The discharging device 1 turns back the material containing device 7 and moves laterally so that the empty material containing device 7 is transferred into the feeding side of the right chamber 12 (or the left chamber 11) of the dual-chamber stepping furnace, and enters the next work circulation.

Hereinafter, the specific application of the single chamber stepping reduction furnace of the reduction firing apparatus according to the present invention will be described.

As shown in FIG. 1, the material containing device 7 which is empty is transferred into the feeding side of the chamber of the single chamber stepping reduction furnace by the discharging device 1. The material containing device 7 is carried and sent forward by the step mechanism 5. The material containing device 7 moves forward to the slag distributing station so as to be uniformly distributed with a layer of slag on the grate bars thereof by the slag distributing device 10. The material containing device 7 moves forward to the charging station so as to be filled with the pallet material to be reduced by the charging device 9. During distributing the slag and charging the material, the furnace materials leaked through the grate bars of the material containing device 7 are stacked in the slag discharging path 8, after a period of time, the valve at the end of the slag discharging path 8 is opened to discharge the leaked material in the slag discharging path 8. The material containing device 7 moves forward to the preheating station, the heating station and the reduction station step by step, and the pellet material in the material containing device 7 is heated by flames of heating burners, and fumes of the flames penetrates the pellet material layers and the grate bars of the material containing device 7 and is pumped out through the fume extraction path 4 at the bottom of the chamber. When the material containing device 7 moves forward to the furnace gate 3 of the discharging side of the single chamber stepping reduction furnace, the transformation of the reduction of the pellet material in the material containing device 7 is accomplished. Next, the furnace gate 3 is opened so that the material containing device 7 and the pellet material therein are carried to the outside of the furnace by the discharging device 1, and then the furnace gate 3 is closed. The sealing cap of the material receiving tank 2 is opened so that the pellet material reduced in the material containing device 7 is poured into the material receiving tank 2 having the sealing cap by the discharging device 1, and then the sealing cap of the material receiving tank 2 is closed. The discharging device 1 turns back the material containing device 7 and moves laterally so as to put the empty material containing device 7 on the crane in parallel with the chamber, and the material containing device 7 is transferred back to be beside to the feeding side of the single chamber stepping furnace, then is transferred into the feeding side of the single chamber stepping furnace by the discharging device 1. A next work circulation begins for the material containing device 7.

Hereinafter, the specific application of the single hearth down-draft reduction furnace of the reduction firing apparatus according to the present invention will be described.

As shown in FIG. 3, the material containing device 7 which is empty is moved laterally under the slag distributing device disposed outside of the reduction furnace by the discharging device 1 so as to be uniformly distributed with a layer of slag on the grate bars thereof. Then the discharging device 1 moves laterally under the charging device disposed outside the reduction furnace so as to be filled with the pallet material to be reduced. The discharging device 1 moves laterally to be in front of the furnace gate 3 of the hearth 13. Next, the furnace gate 3 is opened so that the material containing device 7 is transferred into the hearth 13 by the discharging device 1, and the furnace gate 3 is closed. Flames of the heating burner 6 is fired and adjusted so as to heat the pellet material in the material containing device 7, and fumes of the flames penetrates the material layers and the grate bars of the material containing device 7, and is pumped out through the fume extraction path 4 at a bottom of the hearth 13. The flames of the heating burner 6 are quenched to reduce the pellet material in the material device 7 in the hearth 13. After meeting the requirement of reduction, the furnace gate 3 is opened so that the material containing device 7 is carried out of the hearth 13. The sealing cap of the material receiving tank 2 is opened so that the pellet material reduced in the material containing device 7 is poured into the material receiving tank 2 having the sealing cap by the discharging device 1, and then the sealing cap of the material receiving tank 2 is closed. The discharging device 1 turns back the material containing device 7, and then moves laterally to transfer the empty material containing 7 under the slag distributing device disposed outside the reduction furnace. A next work circulation begins.

[Embodiment 1]

Mixed pellet material or granular material, for which the required reduction firing temperature is about 1350 and the reduction time is about 30 min, is reduced using the dual-chamber stepping reduction furnace or the single chamber stepping reduction furnace. The pellet material or granular material includes vanadium titano-magnetite ore and a reductant, and may optionally include a binder. The step number of the stepping reduction furnace is set to be 18, the step pace is set to be 2 min/step, and the number of the heating burners is set to be 11. During the production, firstly, the mixed pellet material or granular material as well as slag are preheated using fumes of the reduction furnace outside of the reduction furnace, and then the pellet material or granular material is charged into the charging device of the reduction furnace and the slag is charged into the slag distributing device of the reduction furnace. An empty material containing device is transferred into the feeding side of the stepping furnace by the discharging device, is then carried forward by the step mechanism to move forward to the slag distributing station so as to be uniformly distributed with a layer of slag on the grate bars thereof by the slag distributing device. The material containing device moves forward to the charging station so as to be filled with the pellet material or the granular material to be reduced by the charging device. The material containing device moves forward to the preheating station, the heating station and the reduction station step by step, the material in the material containing device is heated by flames generated by a combustion of the coal gas injected from heating burners, and fumes of the flames penetrate the material layers and the grate bars of the material containing device and is pumped out through the fume extraction path at the bottom of the chamber of the stepping furnace. When the material containing device moves forward to the furnace gate of the discharging side of the stepping furnace, the transformation of the reduction of the material in the material containing device is accomplished. Next, the furnace gate is opened so that the material containing device and the material therein are carried outside of the chamber of the stepping furnace by the discharging device, and then the furnace gate is closed. The sealing cap of the material receiving tank is opened so that the material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back to the feeding side of the present chamber using the crane or the trolley, and the work circulation is proceeded in one chamber.

[Embodiment 2]

Mixed pellet material or granular material, for which the required reduction firing temperature is about 1350 and the reduction time is about 30 min, is reduced using the dual-chamber stepping reduction furnace or the single chamber stepping reduction furnace. The pellet material or granular material includes vanadium titano-magnetite ore and a reductant, and may optionally include a binder. The step number of the stepping reduction furnace is set to be 18, the step pace is set to be 2 min/step, and the number of the heating burners is set to be 11. During the production, firstly, the mixed pellet material or granular material as well as slag are preheated using fumes of the reduction furnace outside of the reduction furnace, and then the pellet material or granular material is charged into the charging device of the reduction furnace and the slag is charged into the slag distributing device of the reduction furnace. An empty material containing device is transferred into the feeding side of the stepping furnace by the discharging device, is then carried forward by the step mechanism to move forward to the slag distributing station so as to be uniformly distributed with a layer of slag on the grate bars thereof by the slag distributing device. The material containing device moves forward to the charging station so as to be filled with the pellet material or the granular material to be reduced by the charging device. The material containing device moves forward to the preheating station, the heating station and the reduction station step by step, the material in the material containing device is heated by flames generated by a combustion of the coal powders injected from heating burners, and fumes of the flames penetrate the material layers and the grate bars of the material containing device and is pumped out through the fume extraction path at the bottom of the chamber of the stepping furnace. When the material containing device moves forward to the furnace gate of the discharging side of the stepping furnace, the transformation of the reduction of the material in the material containing device is accomplished. Next, the furnace gate is opened so that the material containing device and the material therein are carried outside of the chamber of the stepping furnace by the discharging device, and then the furnace gate is closed. The sealing cap of the material receiving tank is opened so that the material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back to the feeding side of the present chamber using the crane or the trolley, and the work circulation is proceeded in one chamber.

[Embodiment 3]

Mixed pellet material or granular material, for which the required reduction firing temperature is about 1350 and the reduction time is about 30 min, is reduced using the dual-chamber stepping reduction furnace or the single chamber stepping reduction furnace. The pellet material or granular material includes vanadium titano-magnetite ore and a reductant, and may optionally include a binder. The step number of the stepping reduction furnace is set to be 18, the step pace is set to be 2 min/step, and the number of the heating burners is set to be 10. During the production, firstly, the mixed pellet material or granular material as well as slag are preheated using fumes of the reduction furnace outside of the reduction furnace, and then the pellet material or granular material is charged into the charging device of the reduction furnace and the slag is charged into the slag distributing device of the reduction furnace. An empty material containing device is transferred into the feeding side of the stepping furnace by the discharging device, is then carried forward by the step mechanism to move forward to the slag distributing station so as to be uniformly distributed with a layer of slag on the grate bars thereof by the slag distributing device. The material containing device moves forward to the charging station so as to be filled with the pellet material or the granular material to be reduced by the charging device. The material containing device moves forward to the preheating station, the heating station and the reduction station step by step, the material in the material containing device is heated by flames generated by a combustion of the natural gas injected from heating burners, and fumes of the flames penetrate the material layers and the grate bars of the material containing device and is pumped out through the fume extraction path at the bottom of the chamber of the stepping furnace. When the material containing device moves forward to the furnace gate of the discharging side of the stepping furnace, the transformation of the reduction of the material in the material containing device is accomplished. Next, the furnace gate is opened so that the material containing device and the material therein are carried outside of the chamber of the stepping furnace by the discharging device, and then the furnace gate is closed. The sealing cap of the material receiving tank is opened so that the material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back to the feeding side of the present chamber using the crane or the trolley, and the work circulation is proceeded in one chamber.

[Embodiment 4]

Mixed pellet material or granular material, for which the required reduction firing temperature is about 1350 and the reduction time is about 30 min, is reduced using the dual-chamber stepping reduction furnace or the single chamber stepping reduction furnace. The pellet material or granular material includes vanadium titano-magnetite ore and a reductant, and may optionally include a binder. The step number of the stepping reduction furnace is set to be 18, the step pace is set to be 2 min/step, and the number of the heating burners is set to be 10. During the production, firstly, the mixed pellet material or granular material as well as slag are preheated using fumes of the reduction furnace outside of the reduction furnace, and then the pellet material or granular material is charged into the charging device of the reduction furnace and the slag is charged into the slag distributing device of the reduction furnace. An empty material containing device is transferred into the feeding side of the stepping furnace by the discharging device, is then carried forward by the step mechanism to move forward to the slag distributing station so as to be uniformly distributed with a layer of slag on the grate bars thereof by the slag distributing device. The material containing device moves forward to the charging station so as to be filled with the pellet material or the granular material to be reduced by the charging device. The material containing device moves forward to the preheating station, the heating station and the reduction station step by step, the material in the material containing device is heated by flames generated by a combustion of the heavy oil injected from heating burners, and fumes of the flames penetrate material layers and the grate bars of the material containing device and is pumped out through the fume extraction path at the bottom of the chamber of the stepping furnace. When the material containing device moves forward to the furnace gate of the discharging side of the stepping furnace, the transformation of the reduction of the material in the material containing device is accomplished. Next, the furnace gate is opened so that the material containing device and the material therein are carried outside of the chamber of the stepping furnace by the discharging device, and then the furnace gate is closed. The sealing cap of the material receiving tank is opened so that the material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back and into the feeding side of the present chamber using the crane or the trolley, and the work circulation is proceeded in the one chamber.

[Embodiment 5]

Mixed granular material, for which the required reduction firing temperature is about 1100 and the reduction time is about 30 min, is reduced using the dual-chamber stepping reduction furnace or the single chamber stepping reduction furnace. The granular material includes general iron ore powders and a reductant, and may optionally include a binder. The step number of the stepping reduction furnace is set to be 18, the step pace is set to be 2 min/step, and the number of the heating burners is set to be 9. During the production, firstly, the mixed granular material as well as slag is preheated using fumes of the reduction furnace outside of the reduction furnace, and then granular material is charged into the charging device of the reduction furnace and the slag is charged into the slag distributing device of the reduction furnace. An empty material containing device is transferred into the feeding side of the stepping furnace by the discharging device, is then carried forward by the step mechanism to move forward to the slag distributing station so as to be uniformly distributed with a layer of slag on the grate bars thereof by the slag distributing device. The material containing device moves forward to the charging station so as to be filled with the pellet material or the granular material to be reduced by the charging device. The material containing device moves forward to the preheating station, the heating station and the reduction station step by step, and the granular material in the material containing device is heated by flames generated by a combustion of the coal gas injected from heating burners, and fumes of the flames penetrate the granular material layers and the grate bars of the material containing device and is pumped out through the fume extraction path at the bottom of the chamber of the stepping furnace. When the material containing device moves forward to the furnace gate of the discharging side of the stepping furnace, the transformation of the reduction of the granular material in the material containing device is accomplished. Next, the furnace gate is opened so that the material containing device and the granular material therein are carried outside of the chamber of the stepping furnace by the discharging device, and then the furnace gate is closed. The sealing cap of the material receiving tank is opened so that the granular material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back and into the feeding side of the present chamber using the crane or the trolley, and the work circulation is proceeded in one chamber.

Since it is realized by the present invention that fumes of the flames can penetrate material layers when the material to be reduced is heated by flames of the heating burners, heat is transferred to the material to be reduced in two ways of radiation and conduction, thus the thermal efficiency is improved, and the required reduction temperature can be easily obtained when the material to be reduced is heated by flames generated by the combustion of a fuel having a low calorific value. When the material in present embodiment is reduced using other fuels, only the number of the heating burners needs to be changed and the state of the flames needs to be adjusted, therefore, the detailed description thereof is omitted.

[Embodiment 6]

Mixed pellet material, for which the required reduction firing temperature is about 1100° C. and the reduction time is about 30 min, is reduced using the dual-chamber stepping reduction furnace or the single chamber stepping reduction furnace. The pellet material includes general iron powders and a reductant, and may optionally include a binder. The stepping reduction furnace does not have a slag distributing station. The step number of the stepping reduction furnace is set to be 17, the step pace is set to be 2 min/step, and the number of the heating burners is set to be 9. During the production, firstly, the mixed pellet material is preheated using fumes of the reduction furnace outside of the reduction furnace, and then the pellet material is charged into the charging device of the reduction furnace. An empty material containing device is transferred into the feeding side of the stepping furnace by the discharging device, is then carried forward by the step mechanism to move forward to the charging station so as to be filled with the pellet material to be reduced by the charging device. The material containing device moves forward to the preheating station, the heating station and the reduction station step by step, the pellet material in the material containing device is heated by flames generated by a combustion of coal gas injected from heating burners, and fumes of the flames penetrate the material layers and the grate bars thereof and is pumped out through the fume extraction path at the bottom of the chamber of the stepping furnace. When the material containing device moves forward to the furnace gate of the discharging side of the stepping furnace, the transformation of the reduction of the pellet material in the material containing device is accomplished. Next, the furnace gate is opened so that the material containing device and the pellet material therein are carried outside of the chamber of the stepping furnace by the discharging device, and then the furnace gate is closed. The sealing cap of the material receiving tank is opened so that the pellet material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back and into the feeding side of the present chamber using the crane or the trolley, the work circulation is proceeded in one chamber.

When the material in present embodiment is reduced using other fuels, only the number of the heating burners needs to be changed and the state of the flames needs to be adjusted, therefore, the detailed description thereof is omitted.

[Embodiment 7]

Mixed pellet material or granular material, for which the required reduction firing temperature is about 1350° C. and the reduction time is about 30 min, is reduced using the single hearth down-draft reduction furnace. The pellet material or granular material includes vanadium titano-magnetite ore and a reductant, and may optionally include a binder. During the production, firstly, the mixed pellet material or granular material as well as slag are preheated using fumes of the reduction furnace outside of the reduction furnace, and then the pellet material or granular material is charged into the charging device outside of the reduction furnace and the slag is charged into the slag distributing device outside of the reduction furnace. An empty material containing device is moved laterally under the slag distributing device disposed outside of the reduction furnace by the discharging device so as to be uniformly distributed with a layer of slag on the grate bars thereof. The discharging device moves laterally under the charging device disposed outside of the reduction furnace so as to be filled with the pallet material or granular material to be reduced to the material containing device. The discharging device moves laterally to be in front of the furnace gate of the hearth. Next, the furnace gate is opened so that the material containing device is transferred into the hearth by the discharging device, and the furnace gate is closed. Coal gas injected from the heating burner is fired to generate combusting flames so as to heat the pellet material or the granular material in the material, and the fumes of the flames penetrate the material layers and the grate bars of the material containing device, and is pumped out through the fume extraction path at the bottom of the hearth. After about 20 minutes, the flames of the heating burner are quenched to reduce the pellet material or the granular material in the material device in the hearth. The requirement of reduction is met after about 10 minutes, and the furnace gate is opened so that the material containing device is carried out of the hearth by the discharging device. The sealing cap of the material receiving tank is opened so that the pellet material or the granular material reduced in the material containing device is poured into the material receiving tank having the sealing cap by the discharging device.

When the material in present embodiment is reduced using other fuels, only the number of the heating burners needs to be changed and the state of the flames needs to be adjusted, therefore, the detailed description thereof is omitted.

[Embodiment 8]

Mixed pellet material, for which the required reduction firing temperature is about 1100° C. and the reduction time is about 30 min, is reduced using the single hearth down-draft reduction furnace. The pellet material includes general iron ore powders and a reductant, and may optionally include a binder. During the production, firstly, the mixed pellet material is preheated using fumes of the reduction furnace outside of the reduction furnace, and then the pellet material is charged into the charging device outside of the reduction furnace. An empty material containing device is moved laterally under the charging device disposed outside of the reduction furnace so as to be filled with the pallet material to be reduced. The discharging device moves laterally to be in front of the furnace gate of the hearth. Next, the furnace gate is opened so that the material containing device is transferred into the hearth by the discharging device, and the furnace gate is closed. Coal gas injected from the heating burner is fired to generate combusting flames so as to heat the pellet material in the material containing is heated, and the fumes of the flames penetrate the material layers and the grate bars of the material containing device and is pumped out through the bottom of the hearth. After about 18 minutes, the flames of the heating burner are quenched to reduce the pellet material in the material device in the hearth. The requirement of reduction is met after about 12 minutes, and the furnace gate is opened so that the material containing device is carried out of the hearth by the discharging device. The sealing cap of the material receiving tank is opened so that the pellet material reduced in the material containing device is poured into the material receiving tank having the sealing cap by the discharging device.

When the material in present embodiment is reduced using other fuels, only the number of the heating burners needs to be changed and the state of the flames needs to be adjusted, therefore, the detailed description thereof is omitted.

[Embodiment 9]

Mixed granular material, for which the required reduction firing temperature is about 1100° C. and the reduction time is about 30 min, is reduced using the single hearth down-draft reduction furnace. The granular material includes general iron ore powders and a reductant, and may optionally include a binder. During the production, firstly, the mixed granular material and the slag are preheated using fumes of the reduction furnace outside of the reduction furnace, and then the granular material is charged into the charging device outside of the reduction furnace. An empty material containing device is moved laterally under the slag distributing device disposed outside of the reduction furnace by the discharging device so as to be uniformly distributed with a layer of slag on the grate bars thereof. The discharging device moves laterally under the charging device disposed outside of the reduction furnace so as to be filled with the granular material to be reduced. The discharging device moves laterally to be in front of the furnace gate of the hearth. Next, the furnace gate is opened so that the material containing device is transferred into the hearth by the discharging device, and the furnace gate is closed. Coal gas injected from the heating burner is fired to generate combusting flames so as to heat the granular material in the material containing, and the fumes of the flames penetrates the material layers and the grate bars of the material containing device, and is pumped out through the bottom of the hearth. After about 18 minutes, the flames of the heating burner are quenched to reduce the granular material in the material device in the hearth. The requirement of reduction is met after about 12 minutes, and the furnace gate is opened so that the material containing device is carried out of the hearth by the discharging device. The sealing cap of the material receiving tank is opened so that the granular material reduced in the material containing device is poured into the material receiving tank having the sealing cap by the discharging device.

When the material in present embodiment is reduced using other fuels, only the number of the heating burners needs to be changed and the state of the flames needs to be adjusted, therefore, the detailed description thereof is omitted.

[Embodiment 10]

Mixed pellet material, for which the required reduction firing temperature is about 1200° C. and the reduction time is about 25 min, is reduced using the dual-chamber stepping reduction furnace or the single chamber stepping reduction furnace. The pellet material includes nickel oxide ore powders and coal powders, and may optionally include a binder. The stepping reduction furnace does not have a slag distributing station. The step number of the stepping reduction furnace is set to be 16, the step pace is set to be 2 min/step, and the number of the heating burners is set to be 8. During the production, firstly, the mixed pellet material is preheated using fumes of the reduction furnace outside of the reduction furnace, and then the pellet material is charged into the charging device of the reduction furnace. An empty material containing device is transferred into the feeding side of the stepping furnace by the discharging device, is then carried forward by the step mechanism to move forward to the charging station so as to be filled with the pellet material to be reduced by the charging device. The material containing device moves forward to the preheating station, the heating station and the reduction station step by step, the pellet material in the material containing device is heated by flames generated by a combustion of coal gas injected from heating burners, and fumes of the flames penetrates the material layers and the grate bars of the material containing device, and is pumped out through the fume extraction path at the bottom of the chamber of the stepping furnace. When the material containing device moves forward to the furnace gate of the discharging side of the stepping furnace, the transformation of the reduction of the pellet material in the material containing device is accomplished. Next, the furnace gate is opened so that the material containing device and the pellet material therein are carried outside of the chamber of the stepping furnace by the discharging device, and then the furnace gate is closed. The sealing cap of the material receiving tank is opened so that the pellet material reduced in the material containing device is poured into the material receiving tank having the sealing cap by the discharging device. For the dual-chamber stepping reduction furnace, the discharging device turns the material containing device back and moves laterally so as to transfer the material containing device into the feeding side of the other parallel chamber of the stepping furnace, then a next work circulation begins for the material containing device; and for the single chamber stepping reduction furnace, the material containing device is transferred back and into the feeding side of the present chamber using the crane or the trolley, and the work circulation is proceeded in one chamber.

When the material in present embodiment is reduced using other fuels, only the number of the heating burners needs to be changed and the state of the flames needs to be adjusted, therefore, the detailed description thereof is omitted.

[Embodiment 11]

Mixed pellet material, for which the required reduction firing temperature is about 1200° C. and the reduction time is about 25 min, is reduced using the single hearth down-draft reduction furnace. The pellet material includes nickel oxide ore powders and coal powders, and may optionally include a binder. During the production, firstly, the mixed pellet material is preheated using fumes of the reduction furnace outside of the reduction furnace, and then pellet material is charged into the charging device of the reduction furnace. An empty material containing device is moved laterally under the charging device disposed outside of the reduction furnace so as to be filled with the pallet material to be reduced. The discharging device moves laterally to be in front of the furnace gate of the hearth. Next, the furnace gate is opened so that the material containing device is transferred into the hearth by the discharging device, and the furnace gate is closed. Coal gas injected from the heating burner is fired to generate combusting flames so as to heat the pellet material in the material containing, and the fumes of the flames penetrates material layers and the grate bars of the material containing device, and is pumped out through the bottom of the hearth. After about 16 minutes, the flames of the heating burner are quenched to reduce the pellet material in the material device reducing in the hearth. The requirement of reduction is met after about 9 minutes, and the furnace gate is opened so that the material containing device is carried out of the hearth by the discharging device. The sealing cap of the material receiving tank is opened so that the pellet material reduced in the material containing device is poured into the material receiving tank having the sealing cap by the discharging device.

When the material in present embodiment is reduced using other fuels, only the number of the heating burners needs to be changed and the state of the flames needs to be adjusted, therefore, the detailed description thereof is omitted.

Although the pellet material or the granular material is described as "includes vanadium titano-magnetite ore and a reductant, and may optionally include a binder", "includes vanadium titano-magnetite ore and a reductant, and may optionally include a binder" or "includes nickel oxide ore powders and coal powders, and may optionally include a binder", it should be understood by those skilled in the art that the material used in the present invention includes all the metallic oxides which may be reduced by the reduction firing process. More particularly, since the reduction temperature and the reduction time of these metallic oxides may be obtained through a calculation according to theories of the general metallurgical thermodynamics or dynamics, what just needs to be done by the skilled in the art is to change some technical parameters in the present invention, for example, by setting reduction temperature and reduction time of the reduction firing apparatus as well as by controlling the state of the combustion of fuel in the heating burners, so the reduction production of the above metallic oxides can be realized.

Although the present invention has been shown as above in connection with embodiments, it is should be understood by those skilled in the art that modifications and changes may be made to the present invention without departing from the spirit and scope of the appended claims.

What is claimed is:

1. A method of manufacturing direct reduction iron, which comprises the following steps:

(1) sending a material containing device into a feeding side of one chamber of a dual-chamber stepping furnace using a discharging device;

(2) transferring the material containing device to a slag distributing station using a stepping mechanism of the dual-chamber stepping furnace so as to uniformly distribute a layer of slag on grate bars of the material containing device using a slag distributing device;

(3) moving the material containing device forward to a charging station so as to fill the material containing device with pellet material to be heated and reduced;

(4) moving the material containing device forward through a preheating station, a heating station and a reduction station step by step, heating and reducing the pellet material by flames of heating burners, wherein fumes of the flames penetrate through material layers and the grate bars of the material containing device to be pumped out through a fume extraction path at a bottom of the chamber;

(5) gradually moving the material containing device forward to reach a discharging port of the stepping furnace, opening a furnace gate to withdraw the material containing device from the furnace using a discharging device, closing the furnace gate, and turning over the material containing device to pour the reduced pellet material into a material receiving tank having a sealing cap; and (6) turning the material containing device back and moving the material containing device laterally by the discharging device so as to transfer the material containing device into a feeding side of another parallel chamber of the dual-chamber stepping furnace, and repeating the above method.

2. The method of manufacturing direct reduction iron according to claim 1, wherein the material containing device in the step (1) is a material containing device which has just been baked or from which a material has just been removed, thus the material containing device works at a substantial constant temperature.

3. The method of manufacturing direct reduction iron according to claim 1, wherein the slag in the step (2) has a particle size larger than a distance between adjacent grate bars of the material containing device, which can effectively prevent reduced material from affecting a permeability property of the material containing device due to an adherence of melted material to the grate bars of the material containing device.

4. The method of manufacturing direct reduction iron according to claim 1, wherein the pellet material to be heated and reduced in the step (3) can be replaced by granular material or lump material.

5. The method of manufacturing direct reduction iron according to claim 1, wherein the step (3) is carried out by directly pouring the pellet material to be reduced into the material containing device.

6. The method of manufacturing direct reduction iron according to claim 1, further including a step of heating the slag to be distributed in the material containing device in the step (2) and the pellet material to be reduced in the step (3) using the fumes of the dual-chamber stepping furnace outside of the dual-chamber stepping furnace.

7. The method of manufacturing direct reduction iron according to claim 1, wherein the fumes of the flames pass through the material layers and are pumped out by the fume extraction path at the bottom of the chamber, during heating of the pellet material the flames reduce the pellet material by both of radiation and conduction.

8. The method of manufacturing direct reduction iron according to claim 1, wherein the flames of the heating burners in the step (4) are flames generated by burning gas fuel, liquid fuel or solid fuel.

9. The method of manufacturing direct reduction iron according to claim 1, wherein the step (4) further includes: controlling combustions of fuel as over oxidation combustion or complete oxidation combustion at the preheating station and the heating station and controlling the combustion of fuel as incomplete oxidation combustion at the reduction station.

10. The method of manufacturing direct reduction iron according to claim 1, wherein a reduction temperature and a reduction atmosphere required by reducing different contents of the pellet material can be obtained through controlling burning flames in the step (4), and a required reduction time can be obtained through setting a number of steps and stepping paces of the step mechanism, thereby making it possible to manufacture non-ferrous material which can be manufactured by a firing reduction method.

11. The method of manufacturing direct reduction iron according to claim 1, wherein pouring the reduced pellet material into the material receiving tank having a sealing cap in step (5) is an intermittent instant operation, and the sealing cap of the material receiving tank can be closed in time.

12. The method of manufacturing direct reduction iron according to claim 1, wherein the process of transferring the material containing device into the feeding side of the other parallel chamber of the dual-chamber stepping furnace in the step (6), further includes substituting a material containing device which is damaged or adhered with the molten material with a new baked material containing device, and repairing the substituted material containing device offline.

13. The method of manufacturing direct reduction iron according to claim 1, wherein the material containing device is transferred back and in the feeding side of the one chamber after the material containing device is turned over so that the material containing device can be circled in one chamber.

14. The method of manufacturing direct reduction iron according to claim 1, wherein the material containing device is directly charged with the material to be reduced, is transferred to a position under the heating burners of the dual-chamber stepping furnace by the discharging device, and is stopped under the heating burners; the flames of the heating burners are fired, adjusted and quenched at different time periods, thus a required reduction temperature and a required reduction atmosphere are obtained, and after completing reduction process, the material containing device is carried out of the dual-chamber stepping furnace by the discharging device, then the reduced material are poured into the material receiving tank.

* * * * *

UNITED STATES PATENT AND TRADEMARK OFFICE

CERTIFICATE OF CORRECTION

PATENT NO. : 9,115,412 B2
APPLICATION NO. : 13/909763
DATED : August 25, 2015
INVENTOR(S) : Jinlong Zhan et al.

It is certified that error appears in the above-identified patent and that said Letters Patent is hereby corrected as shown below:

In The Claims

Column 20, Line 58, Claim 14:

After "the reduced material"
Delete "are" and
Insert -- is --.

Signed and Sealed this
Twelfth Day of January, 2016

Michelle K. Lee

Michelle K. Lee
*Director of the United States Patent and Trademark Office*